US005971895A

United States Patent [19]

Habing

[11] Patent Number: 5,971,895

[45] Date of Patent: Oct. 26, 1999

[54] COMBINED PRESS AND ROW EXERCISE ARM

[75] Inventor: Theodore G. Habing, Santa Ana, Calif.

[73] Assignee: Precor Incorporated, Bothell, Wash.

[21] Appl. No.: 08/938,076

[22] Filed: Sep. 26, 1997

[51] Int. Cl.[6] ..... A63B 23/02; A63B 23/12

[52] U.S. Cl. ..... 482/100; 482/137

[58] Field of Search ..... 482/97–100, 136–138

[56] References Cited

U.S. PATENT DOCUMENTS

| | | | |
|---|---|---|---|
| 4,949,951 | 8/1990 | Deola | 482/100 |
| 4,986,538 | 1/1991 | Ish, III | 482/100 |
| 5,236,406 | 8/1993 | Webber . | |
| 5,401,227 | 3/1995 | Webber . | |
| 5,683,334 | 11/1997 | Webber | 482/100 |

OTHER PUBLICATIONS

Pacific Fitness, "Newport, Take a Closer Look" Brochure, One Page, Jul. 1996.

Atech Industries, Inc. "At–6000 Home Gym" Information Sheet, One Page, 1993.

Navtilus Sports/ Medical Industries. "Biceps" Brochure, Two Pages, 1986.

*Primary Examiner*—John Mulcahy

*Attorney, Agent, or Firm*—Blakely, Sokoloff, Taylor & Zafman LLP

[57] ABSTRACT

An exercise machine has an exercise arm with which an operator can perform either press exercises or a seated row exercise from a single seat. The exercise arm has a main arm that is pivotally coupled to the frame of the exercise machine at a main pivot. In an embodiment where the main pivot is above the exercise machine, the main arm has a pair of arm members that depend downwardly to either side of the exercise position. A pair of handle arms are pivotally coupled to the lower ends of respective members of the main arm. To perform press exercises, the handle arms are positioned so as to extend forwardly from the main arm members. While seated in the exercise position, an operator can perform shoulder press, incline press, chest press and decline press exercises. To perform a seated row exercise, the handle arms are positioned to extend rearwardly from the main arm members and the operator sits in the exercise position facing rearwardly, using the backrest of the seat as a chest cushion. Cooperating stops are provided on the main arm members and handle arms so that the handle arms have a semi-locked position for performing the seated row exercise, yet are free to pivot through the range of angles necessary for performing the various types of press exercises.

8 Claims, 5 Drawing Sheets

FIG. 1
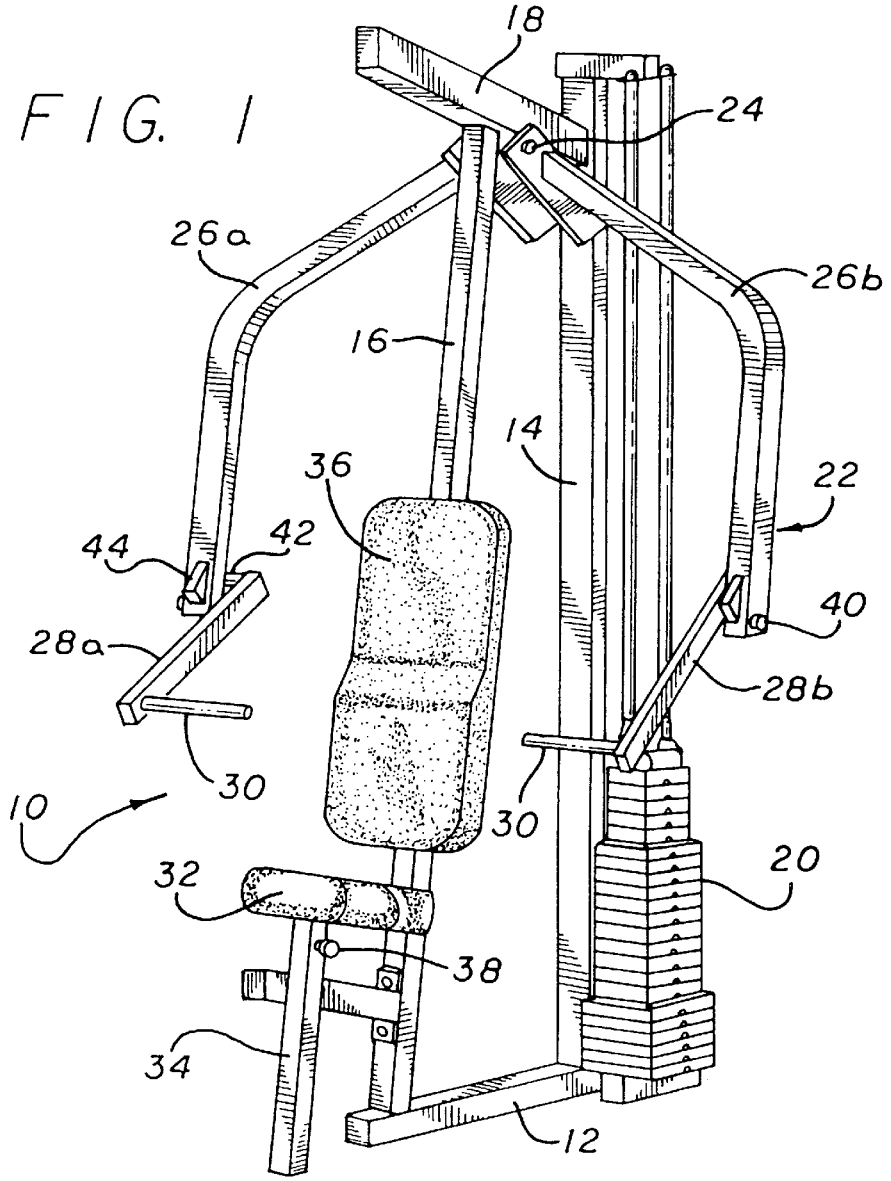
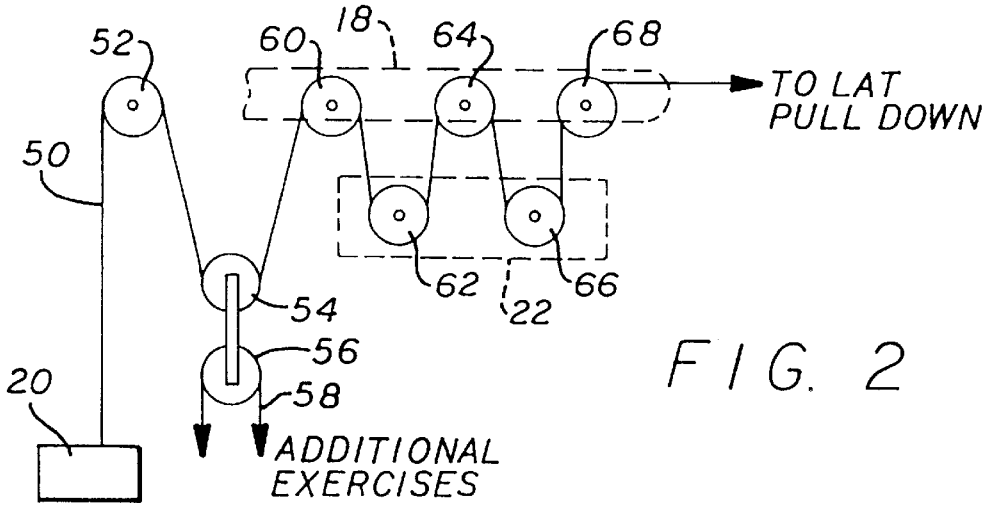
FIG. 2

COMBINED PRESS AND ROW EXERCISE ARM

BACKGROUND OF THE INVENTION

1. Field of the Invention

This invention relates generally to the field of physical exercise equipment and, particularly, to an exercise arm that can be easily configured for performing both press and row exercises.

2. Prior Art

The bench press has long been a popular exercise for developing muscles for the upper body. This exercise is traditionally performed in a supine position on a bench using a bar bell. Within the last few decades, exercise machines have been developed with pivoting press arms coupled to a stack of weights to allow the operator to perform exercises from a seated position. A number of such machines have adjustment features so that shoulder press, incline press, chest press and decline press exercises can all be performed using the same press arm.

The seated row is another popular exercise for developing upper body muscles. Specialized exercise machines have also been developed for performing this exercise. To perform a seated row exercise, the operator typically faces a chest pad and pulls rearwardly on an exercise arm similar to an exercise arm for performing press exercises.

Because of the basic similarities between exercise machines for performing press exercises and those for performing seated row exercises, it would seem that a single machine could provide both exercises. In practice, however, this is difficult to achieve because of the differences in exercise geometry. Consequently, a machine combining both types of exercises must be relatively complex or else the effectiveness of one or both types of exercise is compromised.

U.S. Pat. Nos. 5,236,406 and 5,401,227 disclose an exercise machine in which the press arm is pivotally coupled to the frame of the machine with a "range of motion (ROM) block". The orientation of the ROM block relative to the press arm can be varied with a selector pin. This arrangement will allow the press arm to be positioned for use in performing a seated row exercise. However, due in part to the single pivot geometry of the press arm, it is necessary to also reposition the back pad of the machine so it can be used as a chest pad during a seated row exercise.

The shortcomings of the prior art exercise machines are overcome with the present invention such that both press and seated row exercises can be performed at a single exercise station without reconfiguring the support pads of the exercise station.

SUMMARY OF THE INVENTION

The present invention provides an exercise arm with which an operator can perform either press exercises or a seated row exercise from a single seat. The exercise arm has a main arm that is pivotally coupled to the frame of the exercise machine at a main pivot. In an embodiment where the main pivot is above the exercise machine, the main arm has a pair of arm members that depend downwardly to either side of the exercise position. A pair of handle arms are pivotally coupled to the lower ends of respective members of the main arm. To perform press exercises, the handle arms are positioned so as to extend forwardly from the main arm members. While seated in the exercise position facing forwardly, an operator can perform shoulder press, incline press, chest press and decline press exercises. To perform a seated row exercise, the handle arms are positioned to extend rearwardly from the main arm members and the operator sits in the exercise position facing rearwardly, using the backrest of the seat as a chest cushion. Cooperating stops are provided on the main arm members and handle arms so that the handle arms have a semi-locked position for performing the seated row exercise, yet are free to pivot through the range of angles necessary for performing the various types of press exercises.

BRIEF DESCRIPTION OF THE DRAWINGS

FIG. 1 is a perspective view of an exercise machine constructed in accordance with the present invention.

FIG. 2 is a diagram of the cable and pulley system of the machine of FIG. 1.

DETAILED DESCRIPTION OF THE INVENTION

Figure 3:
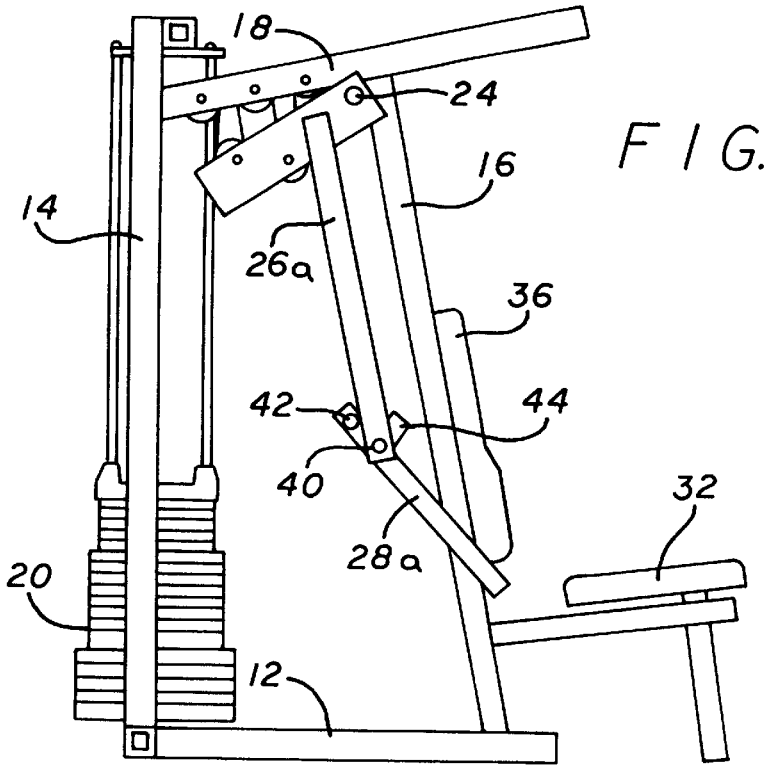
FIG. 3 is a side elevation view of the exercise machine in FIG. 1.

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

An exercise machine 10 constructed in accordance with the present invention is shown in FIG. 1. The frame of exercise machine 10 comprises a base member 12, a rear upright member 14, a front upright member 16 and a top member 18. The principal structural components of exercise machine 10 are preferably constructed from square and/or rectangular steel tubing as is conventional in the art. Exercise resistance is provided by a selectable weight stack 20; however, other sources of exercise resistance may also be utilized, including individual weight plates, hydraulic, pneumatic, electromagnetic or friction mechanisms, or even the operator's own body weight. Although, for the sake of clarity, the present invention is illustrated as an exercise machine dedicated only to press and row exercises, it is to be understood that the invention may also be embodied as part of a multi-station exercise machine with which a variety of other exercises may also be performed.

Exercise arm 22 is pivotally coupled to machine 10 at pivot 24. Arm 22 comprises a main arm having first and second members 26*a* and 26*b*, respectively. Arm 22 further comprises handle arms 28*a* and 28*b* which are pivotally coupled to arm members 26*a* and 26*b*, respectively. Each of the handle arms 28*a* and 28*b* has an inwardly projecting handgrip 30.

A seat for the operator of exercise machine 10 comprises seat cushion 32 coupled to upright post 34 and back cushion 36 coupled to upright frame member 16. The vertical position of seat cushion 32 is preferably adjustable by means of pin 38. Back cushion 36 may be rigidly attached to frame member 16 or may be pivotally attached such that the inclination angle of back cushion 36 is adjustable.

In accordance with conventional practice for similar exercise machines, machine 10 employs a cable and pulley system to couple weight stack 20 to the press arm 22. Details of the cable and pulley system have been omitted from the drawings for the sake of clarity. FIG. 2 is a schematic diagram of a cable and pulley system employed with exercise machine 10 which will accommodate additional exercise stations. A cable 50 is attached to the top of weight stack 20. Cable 50 is guided over pulley 52 which is attached to the frame of machine 10 at the top of upright member 14. Cable 50 continues down and around pulley 54 which is a member of a paired set of floating pulleys also including pulley 56. A second cable 58 is guided around floating pulley 56 and couples to additional exercise stations, such as a leg extension/leg curl arm, a leg press, or an abdominal crunch. Cable 50 continues from floating pulley 54 upwardly to pulley 60, which is one of a set of three pulleys, also including pulley 64 and 68, rotatably mounted on top frame member 18. Cable 50 is interlaced between these pulleys and pulleys 62 and 66 which are rotatably mounted on the exercise arm 22. In a multi-station embodiment, cable 50 typically continues on to a lat pull-down station.

Referring now to FIG. 3, it will be noted that only arm member 26*a* and handle arm 28*a* are visible. However, in the discussion that follows, it is to be understood that all references to arm member 26*a* and handle arm 28*a* apply symmetrically to arm member 26*b* and handle arm 28*b*, respectively. Handle arm 28*a* is coupled to arm member 26*a* at pivot 40. Handle arm 28*a* has a protruding stop 42 at the end adjacent to pivot 40. In the natural rest position of handle arm 28*a*, stop 42 rests against arm member 26*a*, which prevents further downward rotation of the handle arm. This ensures that the handgrips can be easily grasped by the operator when beginning a press exercise and controls the end movement of the press exercise as handle arm 28*a* rotates and stop 42 contacts arm member 26*a*. This, in turn, controls the upward motion of handgrips 30.

Figure 4:
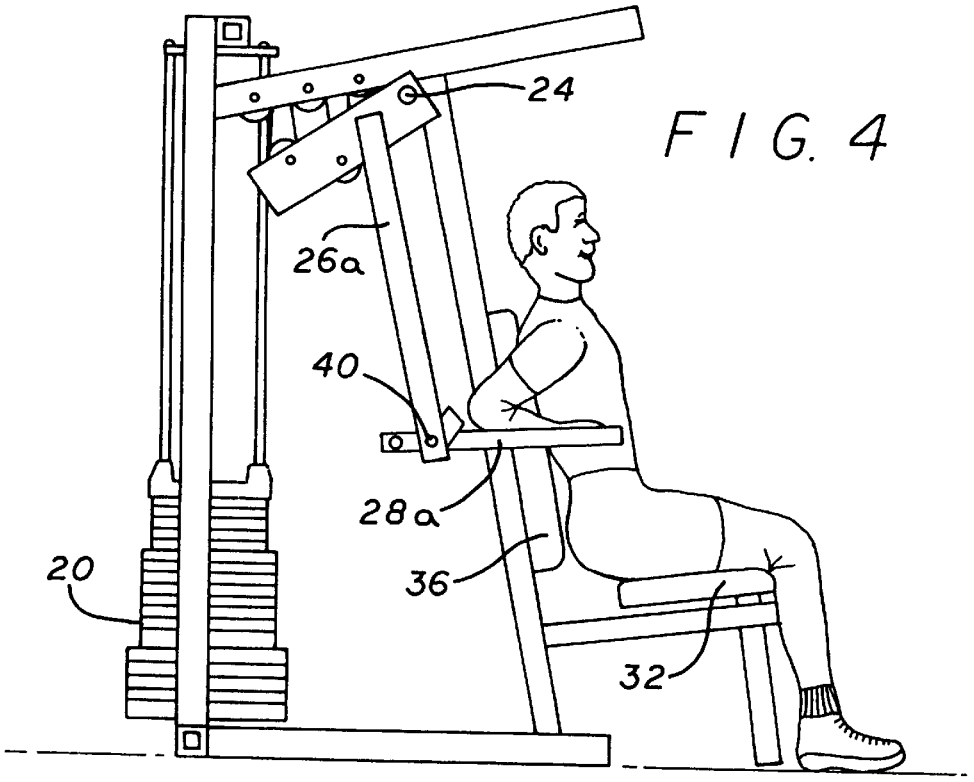
FIG. 4 illustrates the starting position for performing a press exercise using the machine of FIG. 1.

FIG. 4 illustrates the starting position for each of the various press exercises. The operator sits on seat cushion 32 with his back against cushion 36. Grasping handgrips 30, the handle arms are lifted until they are generally aligned with the operator's forearms.

Figure 5:
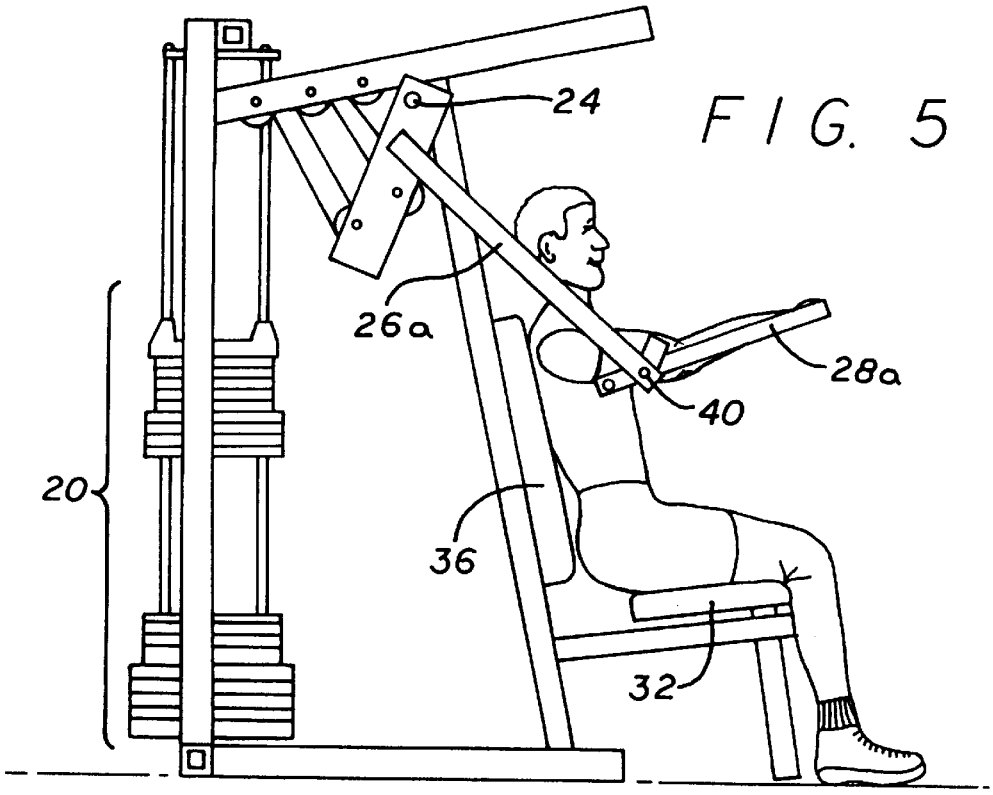
FIG. 5 illustrates the ending position of a chest press exercise using the machine of FIG. 1.

FIG. 5 illustrates exercise machine 10 being used to perform a chest press exercise. In this exercise, the operator pushes essentially straight ahead on handgrips 30, which causes exercise arm 22 to rotate about pivot 24 and lift the selected portion of weight stack 20.

Figure 6:
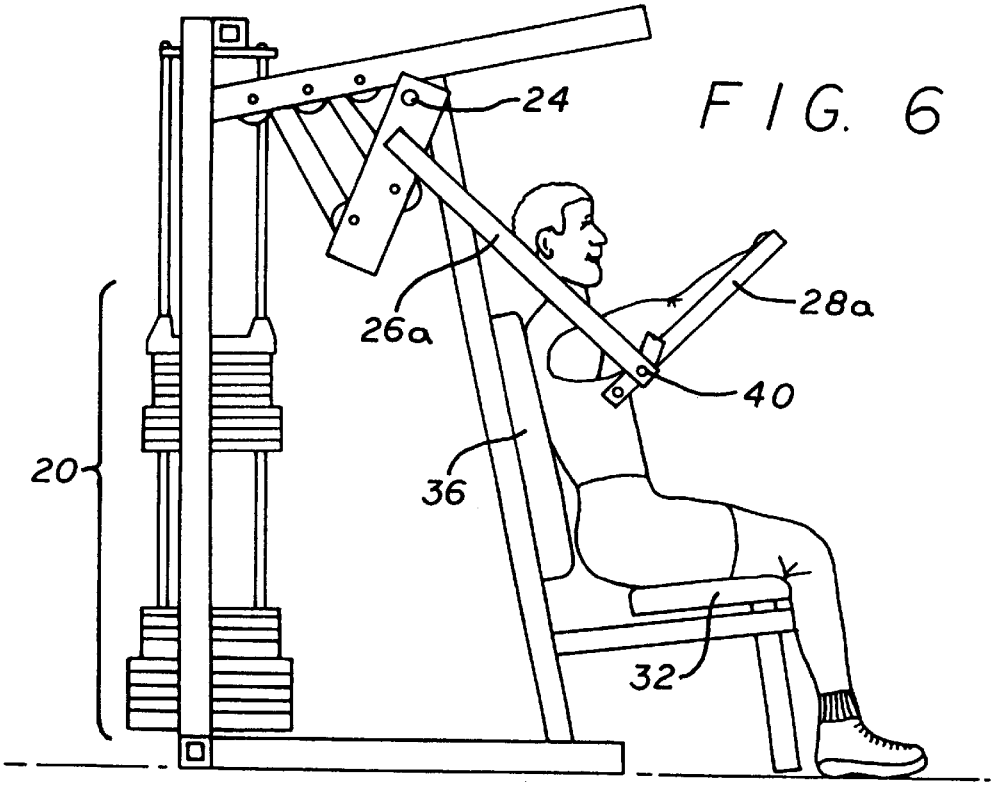
FIG. 6 illustrates the ending position of an incline press exercise using the machine of FIG. 1.

FIG. 6 illustrates exercise machine 10 being used to perform an incline press exercise. Here, the operator pushes both outwardly and upwardly against handgrips 30, again rotating exercise arm 22 about pivot 24 and lifting the selected portion of weight stack 20.

Figure 7:
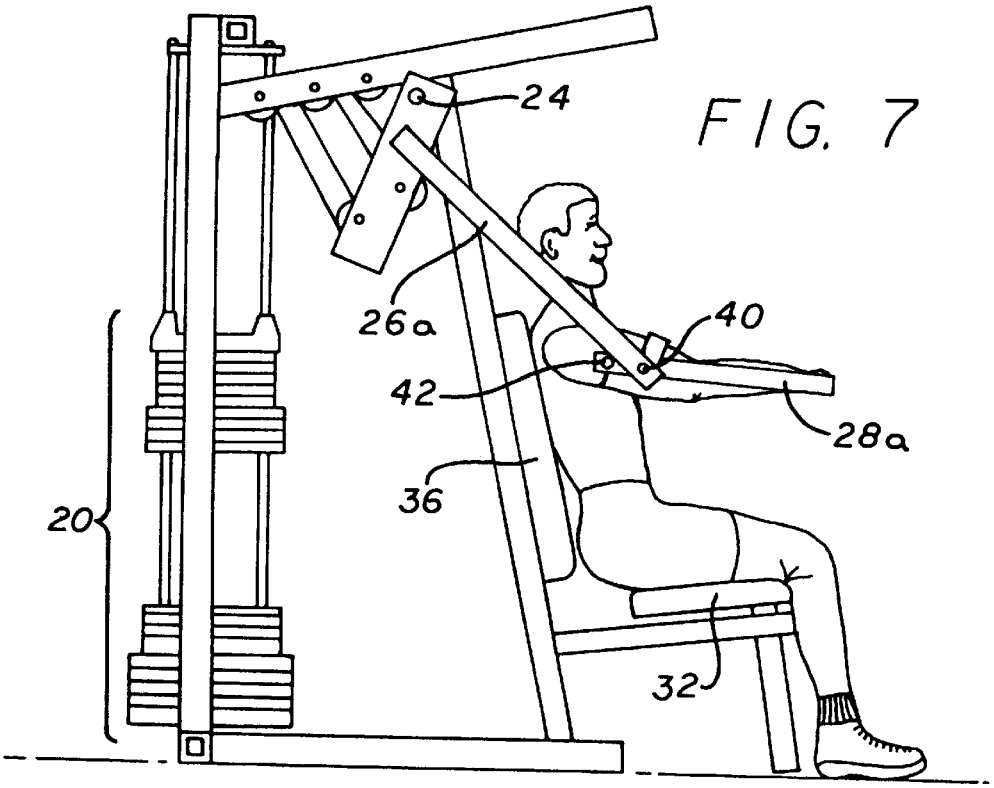
FIG. 7 illustrates the ending position of a decline press exercise using the machine of FIG. 1.

FIG. 7 illustrates exercise machine 10 being used to perform a decline press exercise. In this exercise, the operator pushes outwardly and downwardly against handgrips 30. In this exercise, it should be noted that stops 42 on handle arm 28*a* have engaged arm member 26*a* at the end of the exercise stroke.

All three of the press exercises illustrated in FIGS. 5–7 can be performed from the same operating position on exercise machine 10 as a result of the pivotal coupling between handle arm 28*a* and exercise arm 26*a*. No adjustment of the exercise machine is required.

Figure 8:
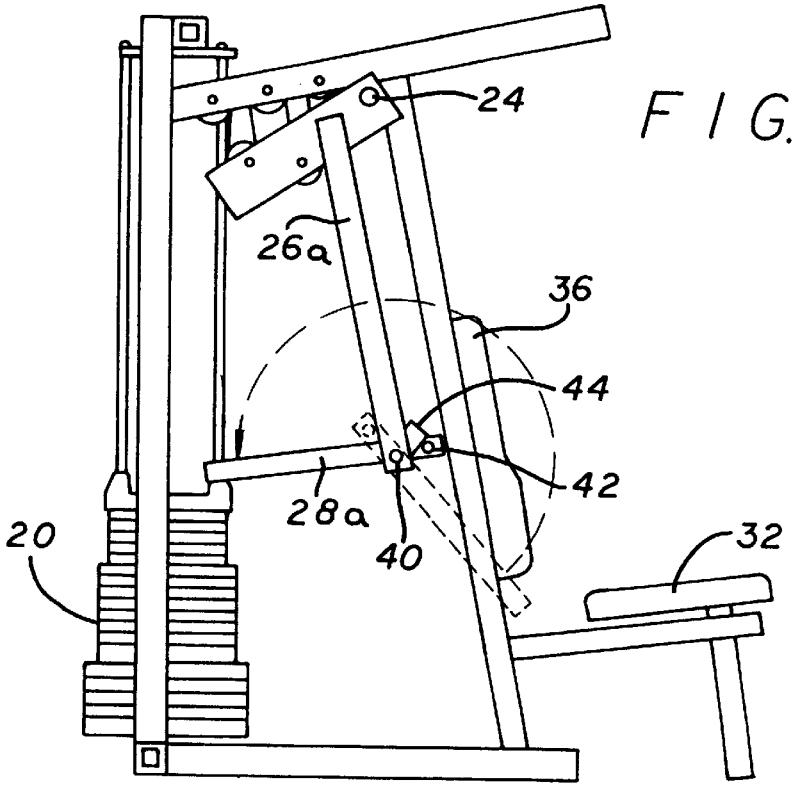
FIG. 8 is a side elevation view of the exercise machine of FIG. 1 configured to perform a seated row exercise.
Figure 9:
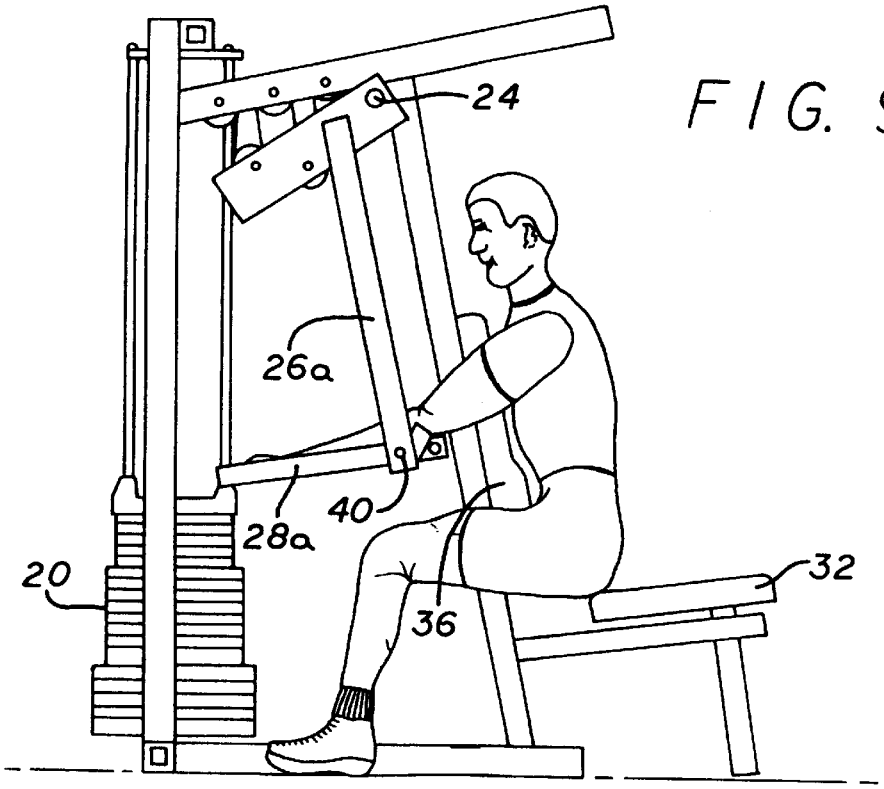
FIG. 9 illustrates the starting position for performing a seated row exercise using the machine of FIG. 1.

In addition to press exercises, exercise arm 22 of machine 10 can be used to perform a seated row exercise. In order to prepare for this exercise, the operator first simply rotates handle arm 28*a* upwardly and rearwardly about pivot 40 as shown in FIG. 8 until stop 42 contacts stop 44 which is rigidly attached to arm member 26*a*. The same is done with handle arm 28*b*. The operator then straddles seat cushion 32 and uses cushion 36 as a chest cushion. With the handle arms rotated for the seated row exercise, the handgrips are positioned in front of the operator. The starting position for the seated row exercise is illustrated in FIG. 9.

Figure 10:
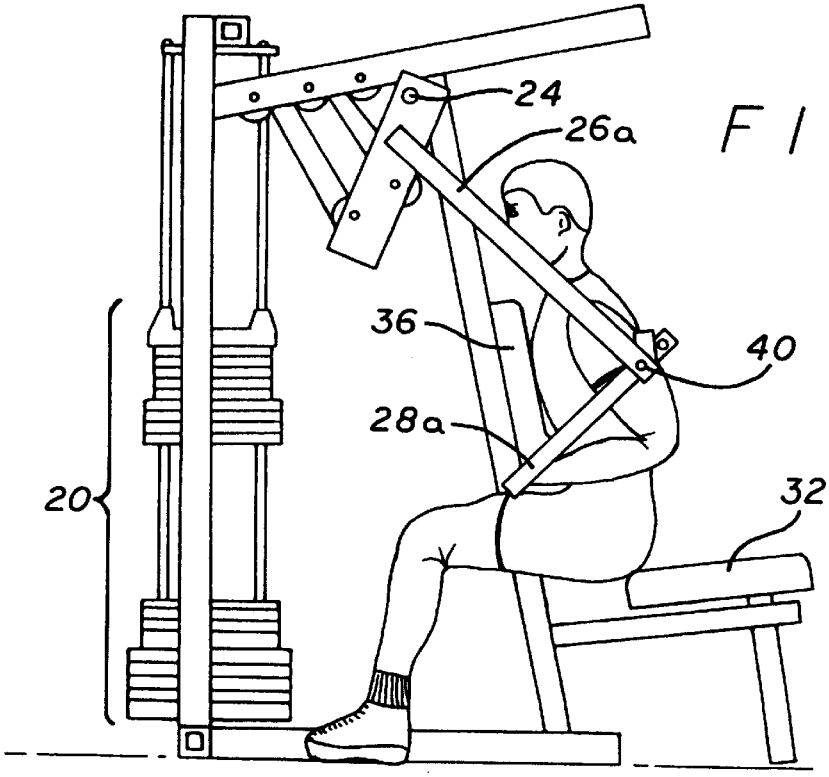
FIG. 10 illustrates the ending position of a seated row exercise using the machine of FIG. 1.

FIG. 10 illustrates exercise machine 10 being used to perform the seated row exercise. The operator performs the exercise by pulling rearwardly on the handgrips 30. The natural movement through the exercise stroke keeps stop 42 in contact with stop 44. Just as in the press exercises, performance of the seated row exercise causes exercise arm 22 to rotate about pivot 24 and thereby lift the selected portion of weight stack 20.

Although the present invention has been described in terms of an embodiment in which the exercise arm is suspended from a pivot at an elevation above the operator's head, it will be appreciated that the present invention can also be embodied in an exercise machine in which the pivot axis of the exercise arm is located on or near the base of the machine.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise machine comprising:

a frame;

a support for an operator of the exercise machine, said support including a generally upright cushion for supporting the operator's back when the operator is in a first exercise position facing a forward direction of the exercise machine and for supporting the operator's chest when the operator is in a second exercise position facing a rearward direction of the exercise machine;

an exercise arm pivotally coupled to the frame on a generally horizontal primary axis, said exercise arm having a rest position;

a handle arm pivotally coupled to the exercise arm on a generally horizontal secondary axis, said handle arm including a handgrip proximate to a first end thereof;

a stop on a second end of the handle arm and a cooperating stop on the exercise arm defining a range of motion for the handle arm about its secondary axis of greater than 90° but less than 360°, the handle arm supported in a first position by the stop such that the handgrip is disposed forwardly of the generally upright cushion when the exercise arm is in the rest position, and the handle arm supported in a second position by the stop such that the handgrip is disposed rearwardly of the generally upright cushion when the exercise arm is in the rest position, said handle arm having a length sufficient for the operator's arm to be fully extended while grasping the handgrip in the second exercise position with the exercise arm in the rest position; and a source of exercise resistance coupled to the exercise arm.

2. The exercise machine of claim 1 wherein the exercise arm is a combined press and row exercise arm.

3. The exercise machine of claim 1 wherein the exercise arm is pivotally coupled to the frame at an elevation above the support.

4. The exercise machine of claim 1 wherein the source of exercise resistance comprises a weight.

5. An exercise machine comprising:

a frame;

a support for an operator of the exercise machine, said support including a generally upright cushion for supporting the operator's back when the operator is in a first exercise position facing a forward direction of the exercise machine and for supporting the operator's chest when the operator is in a second exercise position facing a rearward direction of the exercise machine;

an exercise arm pivotally coupled to the frame on a generally horizontal primary axis and having first and second arm members on opposite sides of the support, said exercise arm having a rest position;

first and second handle arms pivotally coupled to respective arm members on respective generally horizontal secondary axes, each of said handle arms including a handgrip proximate to a first end thereof;

stops on second ends of the handle arms and cooperating stops on the arm members defining a range of motion for each handle arm about its respective secondary axis of greater than 90° but less than 360°, each handle arm supported in a first position by the stop such that the handgrip is disposed forwardly of the generally upright cushion when the exercise arm is in the rest position, and each handle arm supported in a second position by the stop such that the handgrip is disposed rearwardly of the generally upright cushion when the exercise arm is in the rest position, said handle arm having a length sufficient for the operator's arm to be fully extended while grasping the handgrip in the second exercise position with the exercise arm in the rest position; and a source of exercise resistance coupled to the exercise arm.

6. The exercise machine of claim 5 wherein the exercise arm is a combined press and row exercise arm.

7. The exercise machine of claim 5 wherein the exercise arm is pivotally coupled to the frame at an elevation above the support.

8. The exercise machine of claim 5 wherein the source of exercise resistance comprises a weight.

* * * * *

UNITED STATES PATENT AND TRADEMARK OFFICE

CERTIFICATE OF CORRECTION

PATENT NO. : 5,971,895

DATED : October 26, 1999

INVENTOR(S) : Habing

It is certified that error appears in the above-identified patent and that said Letters Patent is hereby corrected as shown below: On the title page: Item In [56], delete "Navtilus Sports" and insert -- Nautilus Sports -- .

Signed and Sealed this

Nineteenth Day of December, 2000

*Attest:*

Q. TODD DICKINSON

*Attesting Officer*

*Commissioner of Patents and Trademarks*